United States Patent [19]

Kinashi et al.

[11] Patent Number: 4,958,197

[45] Date of Patent: Sep. 18, 1990

[54] CLEANING BLADE WITH A SURFACE ACTIVE ANTISTATIC AGENT

[75] Inventors: Hiroshi Kinashi, Kyoto; Itaru Kawabata, Kashiwara; Hidenobu Yamane; Yoshiharu Tsujimoto, both of Yamatokoriyama; Shinya Gotoh, Wakayama; Masayoshi Nawa, Wakayama, all of Japan

[73] Assignees: Sharp Kabushiki Kaisha; Kao Corporation, both of Osaka, Japan

[21] Appl. No.: 262,953

[22] Filed: Oct. 26, 1988

[30] Foreign Application Priority Data

Oct. 30, 1987 [JP] Japan ..... 62-277041
Oct. 30, 1987 [JP] Japan ..... 62-277042

[51] Int. Cl.[5] ..... G03G 21/00
[52] U.S. Cl. ..... 355/299; 15/256.51

[58] Field of Search ..... 355/299, 296; 428/521, 428/492; 15/1.5 A, 1.5 R, 99, 103, 104.93, 256.51

[56] References Cited

U.S. PATENT DOCUMENTS

| | | | |
|---|---|---|---|
| 3,552,850 | 1/1971 | Royka et al. | 15/256.51 X |
| 3,660,863 | 5/1972 | Gerbasi | 15/256.51 X |
| 3,871,762 | 3/1975 | Van Der Vlasakker | 15/256.51 X |
| 4,498,760 | 2/1985 | Sugiyama | 15/256.51 X |
| 4,501,486 | 2/1985 | Landa | 15/256.51 X |
| 4,823,161 | 4/1989 | Yamada et al. | 355/299 |
| 4,825,249 | 4/1989 | Oki et al. | 355/299 |

*Primary Examiner*—A. T. Grimley
*Assistant Examiner*—William J. Royer
*Attorney, Agent, or Firm*—Cohen, Pontani & Lieberman

[57] ABSTRACT

A long life cleaning blade for image forming apparatus is formed of a rubber elastomer which contains, or has adhered on the surface thereof, an antistatic agent in an amount effective to prevent electrification.

14 Claims, 4 Drawing Sheets

CLEANING BLADE WITH A SURFACE ACTIVE ANTISTATIC AGENT

BACKGROUND OF THE INVENTION

1. Field of the Invention

The present invention relates to a cleaning blade and, more particularly, to a cleaning blade attached to a cleaning apparatus of an image forming apparatus such as a dry-type electrophotographic copying machine or electrophotographic printer.

2. Description of the Prior Art

Generally, image formation by an image forming apparatus is obtained by firstly scanning the manuscript with an optical system and exposing a photosensitive drum on which a latent image is formed, and then allowing toner to adhere only to the latent image portion in a developing apparatus. The toner image is transferred to paper which has been fed into the machine and fixed in a fixing apparatus, and then the paper on which the image formation has been completed is ejected from the apparatus. From the toner remaining on the photosensitive drum after completion of the image transfer, the remaining electric charge is removed by a discharger. Then, the remaining toner is removed from the drum by a cleaning blade in a cleaning apparatus, and the photosensitive drum is ready to repeat again the image formation cycle. The toner removed and recovered in the cleaning apparatus is recycled and used again in the developing apparatus.

In the cleaning apparatus of the image forming apparatus as described above, a cleaning blade comprising a rubber elastomer (such as urethane rubber) is widely used now, since it lends itself well to small-sized designs, the assuredness with which cleaning can be effected and the re-usability of the recovered toner.

On the other hand, in accordance with the tendency in recent years of driving image forming apparatus at high speed and to reduce maintenance, various consumptive parts of the apparatus are required to have a longer life and, as a matter of course, many proposals to elongate the life of cleaning blades have been presented.

However, the life of cleaning blades is short compared with that of other parts, because it is necessary to increase the pressure of the blades against the photosensitive drum to improve their cleaning ability. The increased pressure on the blades causes excessive wear. To prevent the wear, the pressure on the blades has to be decreased, and conversely the decreased pressure results in a lessening of the cleaning ability. Thus, it would be the ideal situation to diminish the wear without causing a lessening of the cleaning ability of the blades. On the other hand, it is well known that toner particles serve as a lubricant on the contact surface between the blade and the photosensitive drum which acts naturally to prevent wear. Therefore, the problem can be solved by utilizing the service of this lubricant to its maximum.

At the start of an operation just after exchanging the cleaning blade with a new one, however, adherence of the toner to the surface of the blade edge is still insufficient and the resin powder particles, which have been applied to the new blade to protect its surface, scatter simultaneously with the rotation of the photosensitive drum because of the repulsive force due to frictional electrification and the centrifugal force due to its rotation. Thus, in the interval between when a protecting layer of toner particles or resin powder particles are not present on the blade surface, tear breaking arises on both ends of terminal portions of the blade edge surface, as shown in FIG. 5, on account of the large frictional force. Therefore, it is important that the above-mentioned resin powder particles are caused to adhere to the blade edge surface as long as possible and that the toner particles are caused to adhere to the blade edge surface from the beginning. The biggest reason why the resin powder particles scatter, and the toner particles hardly adhere, is due to the fact that the cleaning blade is frictionally electrified as it is pressed onto the photosensitive drum and repulses these particles.

For the purpose of preventing such electrification of the cleaning blades, there have been proposed Japanese Patent Publications Nos. SHO 44-2034, SHO 56-51347, etc., in which cleaning blades are made electroconductive and grounded.

However, the cleaning blades of the above Japanese Patent Publications Nos. SHO 44-2034, SHO 56-51347, etc., have a defect also in that, when they are used in the so-called Carlson process with a selenium series photosensitive drum, an organic photosensitive drum, an amorphous silicon photosensitive drum, or the like, it follows that the surface of the photosensitive drum is grounded in the cleaning step and the electrification on the photosensitive drum becomes difficult in the next step. Also in a method of applying a definite voltage without grounding, there is the problem that it requires other apparatus, i.e., power source parts increasing the apparatus size and complexity.

The purpose of the present invention is to reduce these inherent defects, as mentioned above, by providing a long-life cleaning blade which is free from the wear of the blade edge surface and, particularly, from the tear breaking on both terminal portions of the edge surface, while improving the cleaning ability, and without requiring any other apparatus, such as power source parts.

SUMMARY OF THE INVENTION

Thus, according to the present invention, there is provided a cleaning blade for image forming apparatus comprising a rubber elastomer which contains, or has adhered on the surface thereof, an antistatic agent in an amount effective to prevent electrification.

According to the cleaning blade of the present invention, the defect as mentioned above is eliminated. That is, in an image forming apparatus provided with a cleaning blade of the present invention, the toner remaining on the photosensitive drum, from which the electric charge remaining after the completion of image transfer has been discharged, is removed by rotation of the photosensitive drum while it is pressed closely against the cleaning blade. At that time, by virtue of the antistatic agent which is contained in or adheres onto the surface of the cleaning blade in a prescribed amount, scattering of toner particles adhering to the blade edge surface, which scattering arises because of the repulsion due to electrification of the blade under friction with the photosensitive drum, is reduced and adhesion of the toner to the blade edge surface in sufficient amounts is realized within a very short time. The toner particles which adhere to the blade edge surface serve as a lubricant to prevent the blade from excessive stress due to friction. Thus, the tear breaking that can arise just after start-up of the use of new blades is prevented.

DESCRIPTION OF THE PREFERRED EMBODIMENT

Figure 1:
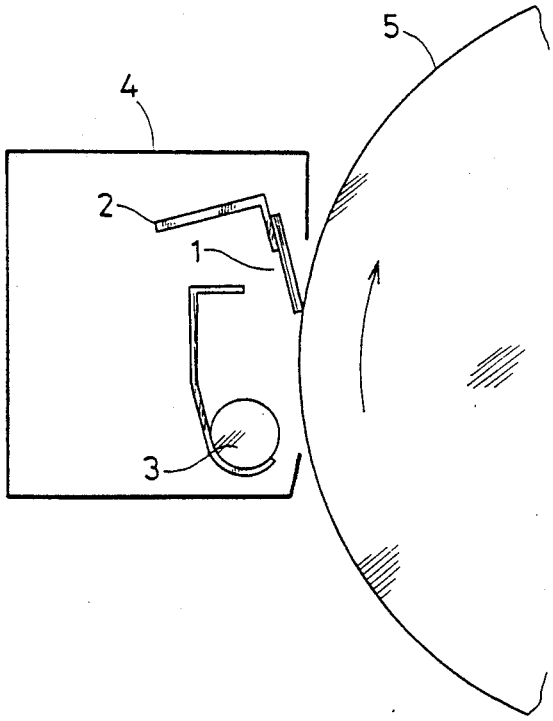
FIG. 1 is a cross-sectional view of a cleaning apparatus provided with a cleaning blade in accordance with the present invention.

As rubber elastomers used in the present invention, those comprising a synthetic rubber having good wear-resistance and good ozone-resistance are suitable. Above all, urethane rubbers are the preferable example. The urethane rubbers can be prepared by treating a polyurethane, which is obtained by a polyaddition reaction of a polyether or polyester having a hydroxyl group at both terminals with a diisocyanate compound, with an aromatic diamine or a polyhydric alcohol to cause cross linking.

Cleaning blades are usually prepared by shaping the above rubber elastomers in a prescribed mold into plates. Therefore, the cleaning blades of the present invention can be prepared by compounding an antistatic agent with the starting rubber elastomer on shaping or by applying an antistatic agent to the surface of the rubber elastomer plate after shaping. It is suitable to adjust the rubber hardness (JIS A hardness) of the cleaning blades at 60–80° by regulating the amount of the cross linking agent used, in order to maintain wear-resistance and not damage the surface of the photosensitive drum.

As antistatic agents used in the present invention, surface active agents are suitable. Any type of surface active agents such as non-ionic, anionic, cationic, amphoteric or electroconductive resinous surface active agents, can be used. From the results of a number of experiments effected in consideration of the molecular weight, HLB (hydrophilic-lipophilic balance), etc., of the surface active agents, it has been found that those surface active agents having a molecular weight of 150–3000 and a HLB of 2.5 or more give very good results. More concretely, the following can be mentioned, as non-ionic surface active agents,
N,N-bis(2-hydroxyethyl)-polyoxyethylenealkylamine,
polyoxyethylenealkylamine,
polyoxyethylenealkylamine fatty acid ester,
glycerine fatty acid ester,
sorbitan fatty acid ester,
polyoxyethylenesorbitan fatty acid ester,
polyoxyethylene fatty alcohol ether,
polyoxyethylene alkyl phenyl ether,
polyethyleneglycol fatty acid ester, etc.,
as anionic surface active agents,
alkylsulfonate,
alkylbenzensulfonate,
alkylsulfate,
alkylphosphate, etc.,
as cationic surface active agents,
tetraalkylammonium salt,
trialkylbenzylammonium salt, etc.,
and as amphoteric ones,
alkylbetaine,
imidazoline type amphoteric surface active agent, etc.

By the way, the above-mentioned HLB is calculated, for example, in the case of polyoxyethylene alkyl ether, according to the formula: HLB=(% of oxyethylene contained)/5, and, in the case of agents containing anionic groups, according to the formula: HLB$-7+\Sigma$ (number of hydrophilic groups) - $\Sigma$ (number of lipophilic groups) (Davis' formula)(Proc. 2nd. Intern. Congress of Surface Activity, 1426 (1957)).

With a surface active agent having a molecular weight more than 3000, the antistatic effect is insufficient because its molecular arrangement is apt to be adversely altered and, when it is compounded with the rubber elastomer, its bleeding out onto the blade surface is disturbed. On the other hand, with a surface active agent having a molecular weight of less than 150, the antistatic effect is also insufficient because its hydrophilic groups are difficult to be arranged in an outward formation. Usually, it is most preferable to use a surface active agent having a molecular weight of 200–600 and a HLB of 5–19.

When such antistatic agents are compounded with the rubber elastomer, if too little an amount is used in the cleaning blades it does not give sufficient antistatic effect and, if too large an amount is used, it is also unsuitable because the blade surface becomes sticky and the hardness, wear-resistance, etc., of the blades is decreased by a plasticizing effect. Usually, it is suitable to use an antistatic agent in an amount of 0.1–10 parts by weight (PHR), preferably 1–5 parts by weight (PHR).

When the antistatic agent is allowed to adhere to the surface of the blades, it is suitable to form a film of about 3–5 molecular layers thick on the blade surface. Accordingly, an adherent amount of 20–50 mg/m$^2$ is usually preferred. By the way, the adherence can be attained conveniently by applying a solution of the antistatic agent to the blade surface by dipping or brushing, and then drying.

EXAMPLES

FIG. 1 is a sectional view of a cleaning apparatus provided with a cleaning blade of an Example of the present invention. The cleaning blade 1 is pressed closely to a photosensitive drum 5 and supported by a blade supporter 2. The blade supporter 2 is fixed by a blade-fixing shaft which is not illustrated. At the lower part of the cleaning apparatus 4, a conventional pipe 3 for recovering toner is provided.

After completion of fixing, the toner remaining on the drum 5, from which the remaining electric charge has been removed by a discharger (not illustrated in the figure), is removed by the cleaning blade 1 which is pressed to the rotating photosensitive drum 5. The toner removed is recovered through the pipe for recovery 3 and recycled to a developing apparatus (not illustrated in the figure).

EXAMPLE 1

A cleaning blade having a rubber hardness of 73° and a thickness of 3 mm was prepared from a urethane rubber used as the rubber elastomer and glycerine fatty acid ester added thereto as the antistatic agent in a weight ratio of 3%.

The urethane rubber used was a commercially available polyester type and a cross linking agent of polyamine series, and the glycerine fatty acid ester used was glycerine monocaprylate having a molecular weight of 220 and a HLB of 5. The addition of the glycerine fatty acid ester was effected by compounding it with the urethane rubber prior to its hardening.

Figure 2:
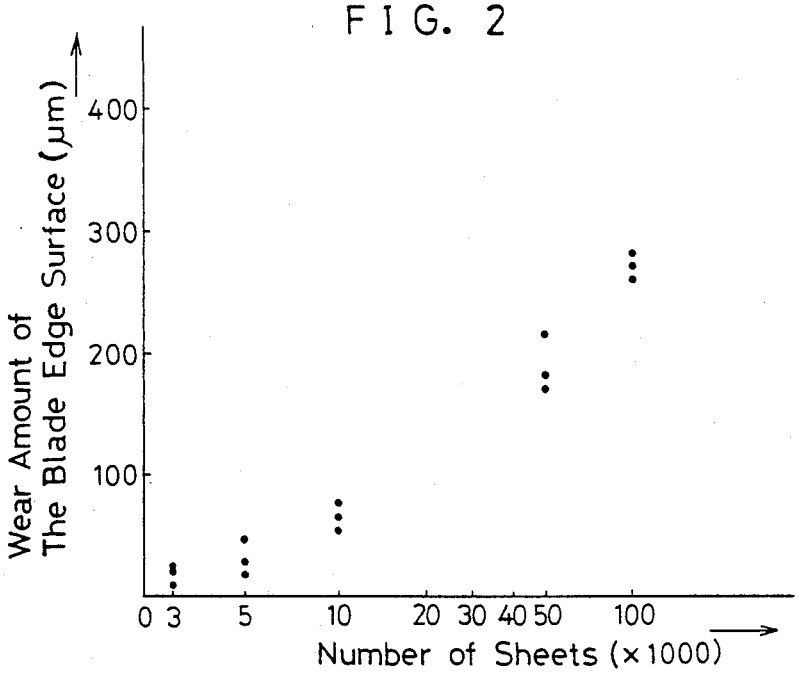
FIG. 2 is a graph showing the results of 100,000 sheets printing-resistance test of one cleaning blade formed in accordance with the invention.

With an image forming apparatus provided with this cleaning blade and an $AS_2Se_3$ photosensitive drum rotating at a peripheral speed of 360 mm/sec, a 100,000 sheets printing-resistance test was carried out. After every image formation of 3,000, 5,000, 10,000, 50,000 and 100,000 sheets, the wear amount of the blade was determined. The number of the image-formed sheets was plotted on the abscissa axis, and the wear amount of the blade edge surface determined at its opposed terminal portions (including the tear breaking) was plotted on the ordinate axis. The results are shown in FIG. 2. Generally, a wear amount at both terminal portions exceeding about 300 μm causes inferior cleaning on images. In the case of this Example, a very good result was obtained without any wear exceeding 300 μm for the image formation of 100,000 sheets.

Besides the above Example, experiments were carried out using various rubber elastomers and various antistatic agents.

For example, in another Example, a urethane rubber having a rubber hardness of 73° was used as the rubber elastomer and polyoxyethylenealkylamine having a molecular weight of 570 and a HLB of 13.0 was added as the antistatic agent in a weight ratio of 3%. A cleaning blade prepared from the urethane rubber having a thickness of 3 mm was attached to an image forming apparatus provided with an $AS_2Se_3$ photosensitive drum rotating at a peripheral speed of 360 mm/sec, and a 100,000 sheets printing-resistance test was carried out. The results obtained were good and approximately the same as those of the above-mentioned Example. The results are graphically shown in FIG. 3.

Figure 3:
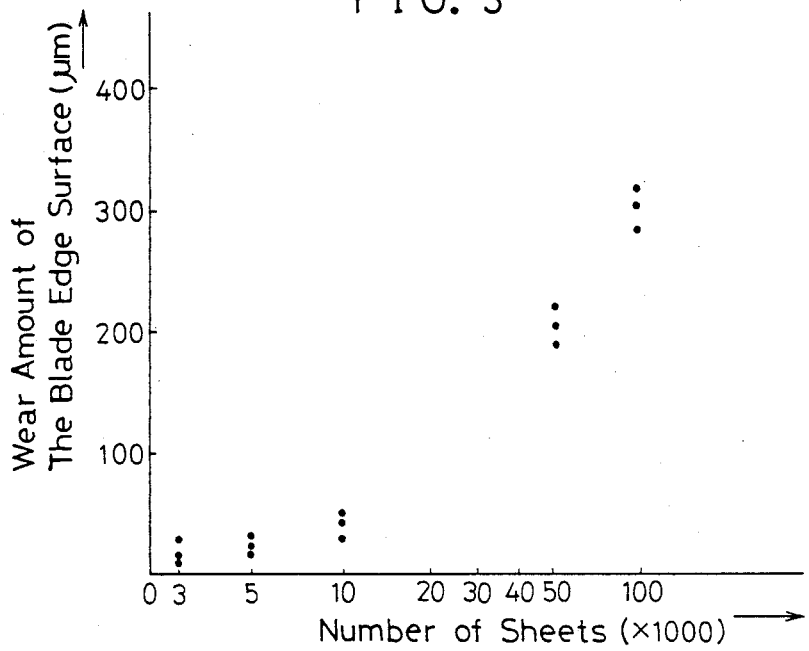
FIG. 3 is a graph showing the results of 100,000 sheets printing-resistance test of another cleaning blade formed in accordance with the invention.

In order to exhibit the effect of the present invention, many experiments were carried out using various rubber elastomers and various antistatic agents, and almost the same results as those shown in FIG. 2 and FIG. 3 were obtained in every case.

REFERENTIAL EXAMPLE 1

Figure 4:
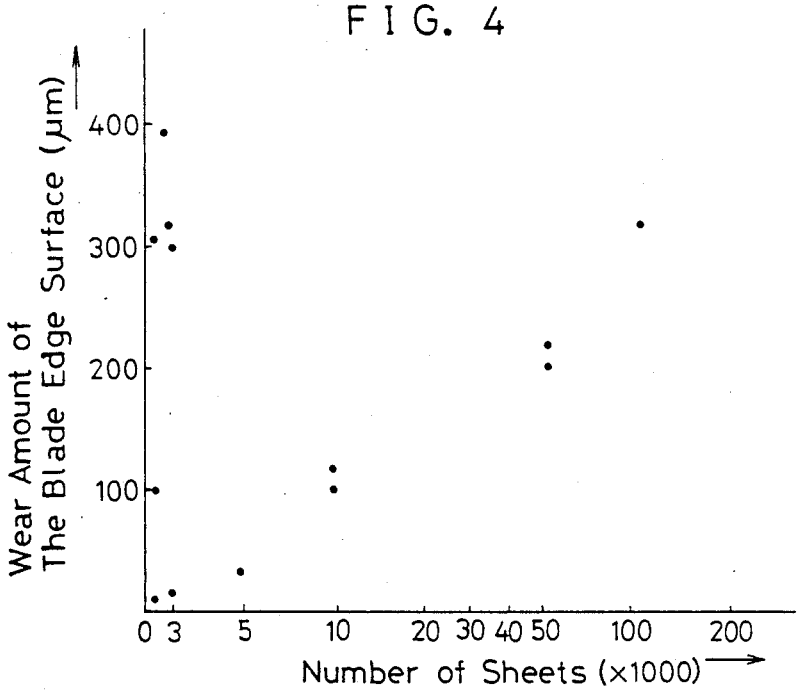
FIG. 4 is a graph showing the results of 100,000 sheets printing-resistance test of a conventional cleaning blade using no antistatic agent.
Figure 5:
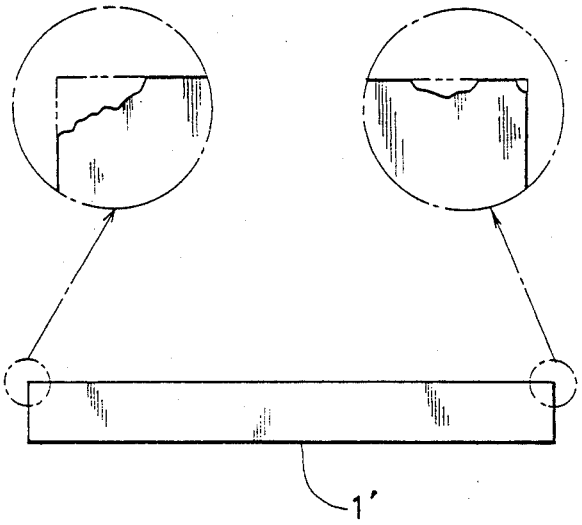
FIG. 5 shows patterns of the tear breaking which arises on both terminal portions of the edge surface of a conventional cleaning blade using no antistatic agent, just after start-up using the blade.

With a cleaning apparatus provided with a cleaning blade not using any antistatic agent, a 100,000 sheets printing-resistance test was carried out with various image forming apparatus each provided with a different photosensitive drum, and the results obtained are shown in FIG. 4. In order to confirm the severity of the wear just after the start-up use, the wear amount was also measured after the image formation of 1,000 sheets. After image formation of several thousands sheets, a cracking arose and the reverse wear just after the start of use was confirmed by generation of tear breaking corresponding to a wear amount of 300 μm or more, generation of a wide wear extending to about 400 μm after image formation of 3,000 sheets, and so on. Thus, it became evident that the cleaning blade of the Example of the present invention attained extended wear life.

EXAMPLE 2

Figure 6:
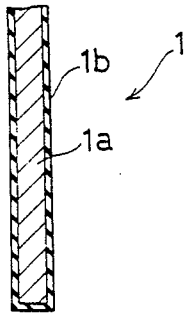
FIG. 6 is a partial sectional view of a cleaning blade formed in accordance with the present invention.

FIG. 6 is a sectional view of a cleaning blade 1 of another Example of the present invention. In this blade, an antistatic layer **1*b* is formed on the surface of the blade body 1*a* comprising a rubber elastomer. A urethane rubber having a rubber hardness of 73° and a thickness of 3 mm was used as the rubber elastomer, and an anionic surface active agent of an alkylphosphate type diluted with water and alcohol was applied (0.3 weight %) to its surface and dried to form the antistatic layer 1*b***. The anionic surface active agent used was distearyl sodium phosphate having a molecular weight of 650 and a HLB of 18.

The cleaning blade of this Example was furnished to an image forming apparatus provided with a selenium series photosensitive drum rotating at a peripheral speed of 360 mm/sec, and 100,000 sheets printing-resistance test was carried out. The results obtained are graphically shown in FIG. 7. After every image formation of 3,000, 5,000, 10,000, 50,000 and 100,000 sheets the wear amount of the blade was measured. The number of the image-formed sheets was plotted on the abscissa axis, and the wear amount measured on the blade edge surface at both its terminal portions (including the tear breaking) was plotted on the ordinate axis. Generally, a wear amount at both terminal portions exceeding about 300 μm causes inferior cleaning of images on the photosensitive drum. In the case of this Example, however, no wear exceeding 300 μm arose up to image formation of 100,000 sheets and a very good result was obtained.

Besides the foregoing Example, experiments were carried out by changing the kinds of rubber elastomers and antistatic agents.

For example, in another Example, a urethane rubber having a rubber hardness of 66° was used as the rubber elastomer and, to the surface of a blade prepared from urethane rubber having a thickness of 3 mm, a betaine type surface active agent (stearyl betaine ; molecular weight 360, HLB 18; 0.3 weight %) diluted with a mixture of water and alcohol was applied and then dried to form the antistatic layer. The cleaning blade thus prepared was attached to an image forming apparatus provided with an amorphous silicon photosensitive drum, and a 100,000 sheets printing-resistance test was effected by rotating the photosensor at a peripheral speed of 360 mm/sec. The results are graphically shown in FIG. 8. They were good and approximately the same as the results of the above-mentioned Example.

Figure 7:
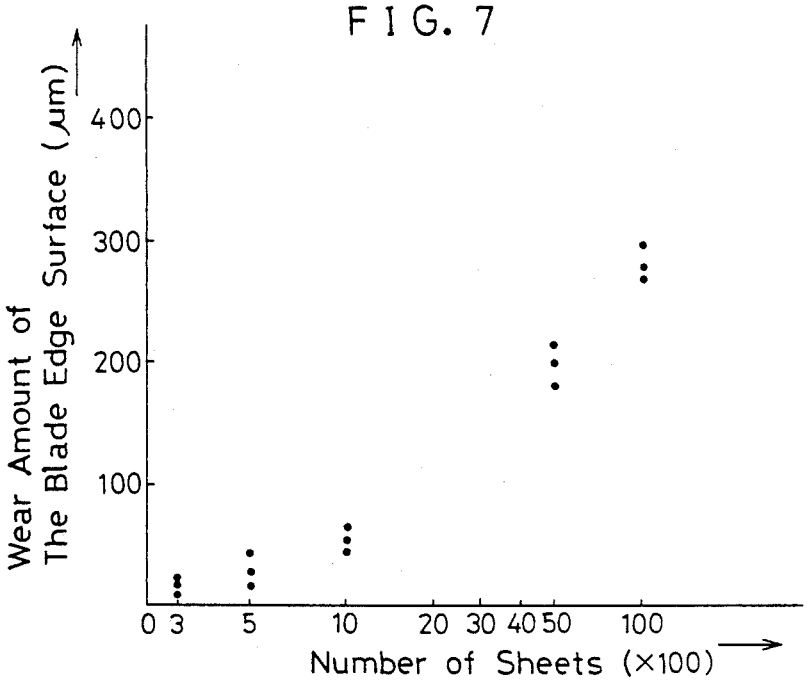
FIG. 7 is a graph showing the results of 100,000 sheets printing-resistance test of the cleaning blade of FIG. 6.
Figure 8:
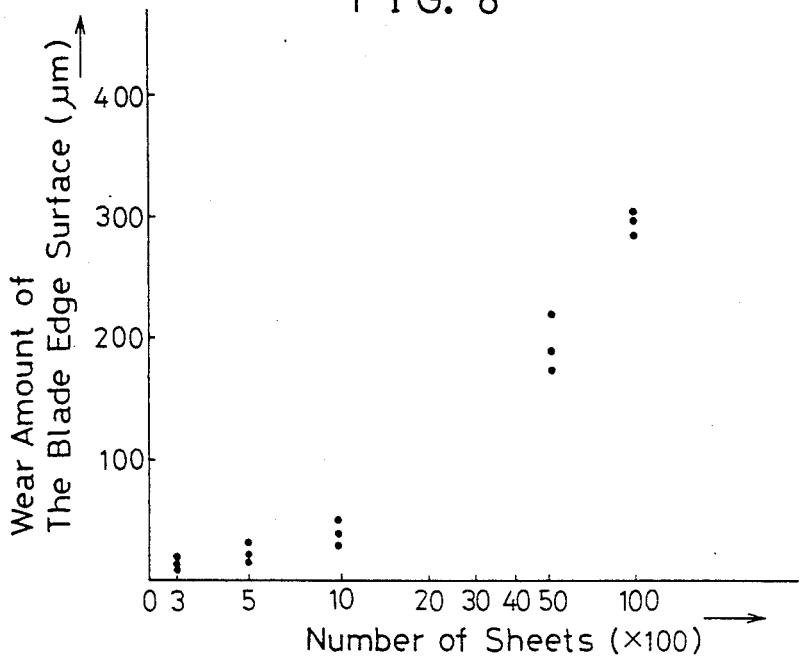
FIG. 8 is a graph showing the results of 100,000 sheets printing-resistance test of yet another cleaning blade formed in accordance with the invention.

In order to exhibit the effect of the present invention, many experiments were carried out with various kinds of rubber elastomers and antistatic layers, whereby almost the same results as shown in FIG. 7 and FIG. 8 were obtained in every case.

EXAMPLE 3

In the same manner as Example 2, urethane rubber cleaning blades having various surface active agents adhering on the surface were prepared, and their surface resistance was determined. The results are shown in the following table, along with Comparative Examples.

| | | Antistatic agent | HLB | Mw | resistance (Ω) |
|---|---|---|---|---|---|
| Example | A | Sorbitan fatty acid monoester | 6.7 | 400 | $10^{10}$ |
| | B | Polyethyleneglycol fatty acid ester | 13.4 | 600 | $10^{10}$ |
| | C | Polyoxyethylene-alkylamine | 13.0 | 570 | $10^{10}$ |
| | D | Glycerine fatty acid monoester | 5 | 220 | $10^{10}$ |
| | E | Polyoxyethylene alkyl ether | 8.8 | 400 | $10^{10}$ |
| Comparative Example | A | Polyoxyethylene alkyl phenyl ether | 18.9 | 3000 | $10^{14}$ |
| | B | Polyoxyethylene alkyl ether | 7.1 | 146 | $10^{14}$ |
| | C | Sorbitan fatty acid triester | 2.1 | 900 | $10^{14}$ |

According to the present invention, it is possible to prevent the scattering of resin powder adherent to the conventional cleaning blades comprising a rubber elastomer, that arises just after the start of the use of the blades and, at the same time, to allow the toner particles to adhere quickly to the blade surface. The toner adherent to the blade surface serves as a lubricant immediately and, as a result, prevents the blade surface, especially its edge portions, from undergoing excessive stress due to friction. Thus, the wear on blades that normally occurs just after the start of their use is largely decreased and therefore, improvement in the cleaning ability and extension of the life of the blades are attained.

What we claimed is:

1. A cleaning blade for an image forming apparatus that includes an image-receiving photosensitive surface into contact with which the blade is movable for cleaning toner from the photosensitive surface, said cleaning blade comprising:

a rubber elastomer; and a surface active antistatic agent forming a unitary part of said blade and disposed for contact with the photosensitive surface when said blade is moved into contact with said photosensitive surface so as to prevent an accumulation of electric charges on said cleaning blade and thereby facilitate maintenance of a layer of toner particles on said blade for imparting to the blade sufficient lubrication to minimize damage to the blade as the blade contacts the photosensitive surface.

2. A cleaning blade in accordance with claim 1, wherein said blade is formed of a mixture of said rubber elastomer and said surface active antistatic agent.

3. A cleaning blade in accordance with claim 1, wherein said blade comprises a body formed of said rubber elastomer, said body having an outer surface, and a layer of said surface active antistatic agent unitarily carried on and adhered to said body outer surface for contact with the photosensitive surface.

4. A cleaning blade in accordance with claim 1, wherein said antistatic agent comprises a non-ionic surface active agent.

5. A cleaning blade in accordance with claim 1, wherein said antistatic agent comprises an anionic surface active agent.

6. A cleaning blade in accordance with claim 1, wherein said antistatic agent comprises a cationic surface active agent.

7. A cleaning blade in accordance with claim 1, wherein said antistatic agent comprises an amphoteric surface active agent.

8. A cleaning blade in accordance with claim 1, wherein said antistatic agent comprises an electroconductive resinous surface active agent.

9. A cleaning blade in accordance with claim 1, wherein said antistatic agent has a molecular weight in the range of approximately 150 to 3000 and a HLB of at least approximately 2.5.

10. A cleaning blade in accordance with claim 1, wherein said antistatic agent has a molecular weight in the range of approximately 200 to 600 and a HLB in the range of approximately 5 to 19.

11. A cleaning blade in accordance with claim 2, wherein said antistatic agent is contained in said blade in an amount in the range of approximately 0.1 to 10 parts by weight (PHR).

12. A cleaning blade in accordance with claim 2, wherein said antistatic agent is contained in said blade in an amount in the range of approximately 1 to 5 parts by weight (PHR).

13. A cleaning blade in accordance with claim 3, wherein said antistatic agent is carried on said blade outer surface in an amount in the range of approximately 20 to 50 mg/m$^2$.

14. A cleaning blade in accordance with claim 1, wherein said cleaning blade has a rubber hardness in the range of 60 to 80°.

* * * * *